United States Patent [19]

Shibata et al.

[11] 4,438,525

[45] Mar. 20, 1984

[54] REVERBERATION APPARATUS

[75] Inventors: Takashi Shibata, Kamakura; Masaaki Nishimura, Tokyo, both of Japan

[73] Assignee: Sony Corporation, Tokyo, Japan

[21] Appl. No.: 333,557

[22] Filed: Dec. 22, 1981

[30] Foreign Application Priority Data

Dec. 23, 1980 [JP] Japan ..... 55-185939[U]

[51] Int. Cl.[3] ..... G10H 1/02

[52] U.S. Cl. ..... 381/63; 333/138; 84/DIG. 26

[58] Field of Search ..... 84/DIG. 4, DIG. 26, 84/DIG. 21; 307/607; 381/63, 64, 65; 333/145, 138

[56] References Cited

U.S. PATENT DOCUMENTS

| | | | |
|---|---|---|---|
| 3,221,092 | 11/1965 | Rogers | 179/1 J |
| 4,087,631 | 5/1978 | Yamada et al. | 179/1 GP |
| 4,184,047 | 1/1980 | Langford | 179/1 J |

OTHER PUBLICATIONS

"Bucket-Brigade Delay-Line Enhances Sound Reproduction", Electronic Components and Applications, vol. 2, No. 2, (Feb. 1980), pp. 80–82.

*Primary Examiner*—G. Z. Rubinson
*Assistant Examiner*—James L. Dwyer
*Attorney, Agent, or Firm*—Hill, Van Santen, Steadman & Simpson

[57] ABSTRACT

A reverberation apparatus is formed of bucket brigade delay circuit having its input connected to a signal source. An output of the delay circuit is connected through a spring-type reverberator to one of two inputs of an adder, the other being connected to the signal input. The output of the adder provides the desired reverberation sound. In one embodiment, two series connected delay circuits and reverberators are provided, each connecting to a respective input of a respective adder. The other inputs of each adder are connected to the signal source and the outputs of the respective adders provide separate stereophonic-like left and right channel outputs.

8 Claims, 13 Drawing Figures

(L/R Independent)

(L/R Mix)

(Monaural)

(L/R Change)

REVERBERATION APPARATUS

BACKGROUND OF THE INVENTION

1. Field of the Invention

The present invention relates generally to a reverberation apparatus, and is directed more particularly to a reverberation apparatus which can generate a natural reverberation sound.

2. Description of the Prior Art

In the art, there have been already proposed various types of reverberation apparatus, one example of which is shown in FIG. 1. In the prior art example shown in FIG. 1, an original signal is applied through an input terminal 1 to an adder or adding device 2, at which a reverberation signal described later is added to the original signal, and then delivered to an output terminal 3. The aforementioned reverberation signal is at first provided through a delay circuit 4 which consists of, for example, a BBD (bucket brigade device), an attenuator 5, and an adder 6. In detail, the original signal applied to the input terminal 1 is supplied through the adder 6 to delay circuit 4 to be delayed thereby. The delayed signal therefrom is applied to the adder 2 to be added to the original signal, and at the same time is fed back to the adder 6 through the attenuator 5. In this case, signals $b_1$ and $b_2$ are repeatedly derived from the delay from the delay circuit 4 for the original signal a as shown in the graph of FIG. 2.

The reverberation signal is also generated by a reverberator 7. That is, the original signal applied to the input terminal 1 is also applied to the reverberator 7, the output reverberation signal from which is also applied to the adder 2 to be added to the original signal. In this case, the reverberation signal from the reverberator 7 becomes as shown by a curve c in the graph of FIG. 2.

According to the above prior art reverberation apparatus, since the output signal from the delay circuit 4 is fed back to generate the reverberation sound, a defect inherent therein is exaggerated so that the reverberation perceived by a person's auditory senses is not good.

Furthermore, in the prior art reverberation apparatus, since the reverberator 7 is connected merely in parallel to the original signal path, the reverberation time and the reverberator 7 itself become short so that it is impossible to generate a reverberation sound which is deep and wide.

OBJECTS AND SUMMARY OF THE INVENTION

Accordingly, an object of the present invention is to provide a reverberation apparatus free from the defects inherent in the prior art.

Another object of the invention is to provide a novel reverberation apparatus in which a delay circuit and a spring type reverberator are connected in series.

According to an aspect of the present invention there is a signal input terminal which is supplied with an input signal; a delay circuit having input and output terminals, said input terminal being connected to said signal input terminal; a spring type reverberator having input and output terminals, the input terminal of which is connected to the output terminal of said delay circuit means; and a summing circuit having a pair of input terminals and an output terminal. The pair of input terminals is connected to the signal input terminal and the output terminal of the spring type reverberator respectively. The output terminal of the summing circuit produces a reverberation sound. The other objects, features and advantages of the present invention will become apparent from the following description taken in conjunction with the accompanying drawings through which the like reference numerals designate the same elements and parts.

DESCRIPTION OF THE PREFERRED EMBODIMENTS

The present invention will be hereinafter described with reference to the attached drawings.

A first example of the reverberation apparatus according to the invention will be now described with reference to FIG. 3.

Figure 1:
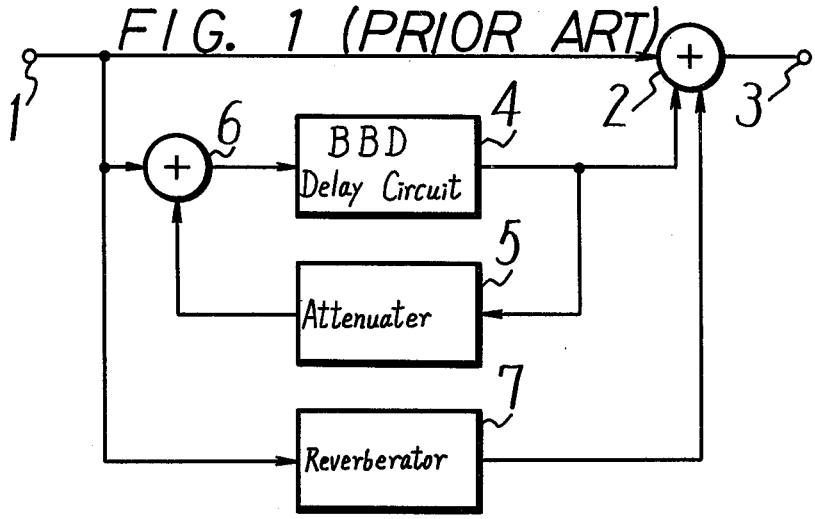
FIG. 1 (PRIOR ART)
FIG. 1 is a block diagram showing a prior art reverberation apparatus.
Figure 2:
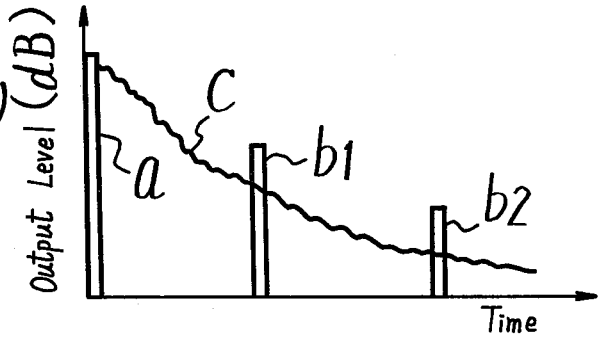
FIG. 2 (PRIOR ART)
FIG. 2 is a graph showing the output characteristic of the prior art reverberation apparatus shown in FIG. 1.
Figure 3:
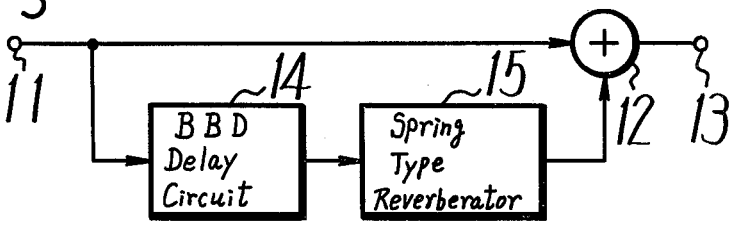
FIG. 3 is a block diagram showing an example of the reverberation apparatus according to the present invention.
Figure 4:
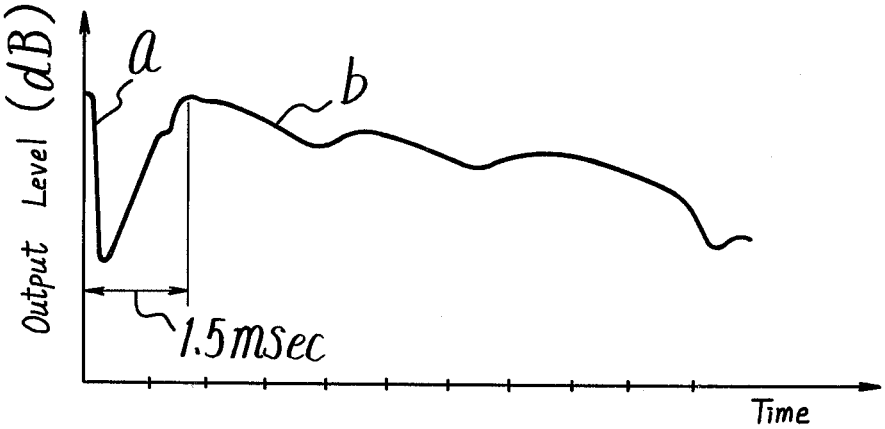
FIGS. 4 and 5 are each a graph used to explain the example of the invention shown in FIG. 3.

In FIG. 3, 11 designates an input terminal to which an original signal is applied. The original signal applied to the input terminal 11 is delivered through an adder 12 to an output terminal 13, and is also fed for delay to a delay circuit 14 made of a BBD (A bucket brigade device—BBD—is well known in the prior art and consequently a description of the same is omitted here.) The delayed signal therefrom is fed to a spring type reverberator 15, the output signal from which is applied to the adder 12 to be added to the original signal. In this case, the spring type reverberator 15 functions such that when a tone burst a shown by the curve in the graph of FIG. 4 is directly applied to the spring type reverberator 15 and mixer 12, it generates at the output of the mixer 12 a reverberation signal b as shown in the graph of FIG. 4 by the curve, in which the peak of the reverberation signal b appears at a time after the supply of the tone burst a 1.5 m sec (milli-seconds). The spring-type reverberator 15 of the invention is well-known in the prior art and consequently the specific design of the same is omitted here.

Figure 5:
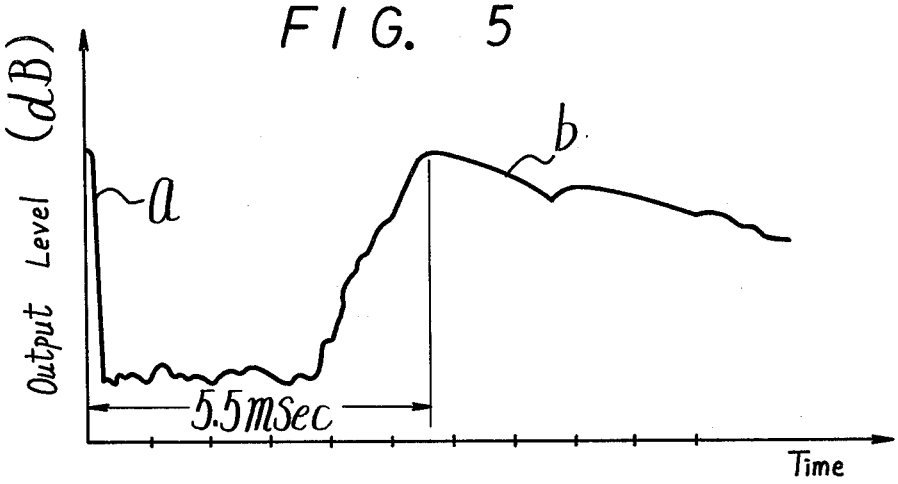

With the reverberation apparatus of the invention shown in FIG. 3, since the original signal is delayed by the delay circuit 14 and then applied to the spring type reverberator 15, the peak of the reverberation signal b at the output of mixer 12 appears at a time 5.5 m sec after the application of the tone burst a as shown in the graph of FIG. 5. Accordingly, the original signal can be clearly separated from the reverberation signal or the original signal is clarified. Further, the reverberation time is expanded by the delay time of the delay circuit 14 so that the expansion feeling of the reverberation sound can be improved. In addition, the reverberation sound of a high level appears suddenly after the delay time of the delay circuit 14, for example 5.5 m sec, so that a deep reverberation feeling can be obtained.

As described above, according to the reverberation apparatus of this invention, since the delay circuit 14 made of a BBD and the spring type reverberator 15 only are used, the reverberation apparatus is very simple in construction. Furthermore, since the peak of the reverberation signal can be delayed substantially by the delay time of the delay circuit 14, the original signal can be clarified and also the deep reverberation feeling can be maintained and the expansion feeling of the reverberation sound can be realized by the spring type reverberator 15.

It has been determined that the most natural expansion feeling is perceived when the delay time of the delay circuit 14 made of a BBD is 40 to 50 m sec.

Another example of the reverberation apparatus according to the invention will be now described with reference to FIG. 6 in which the references which are the same as those of FIG. 3 denote the same elements and parts, and their detailed description will be omitted.

Figure 6:
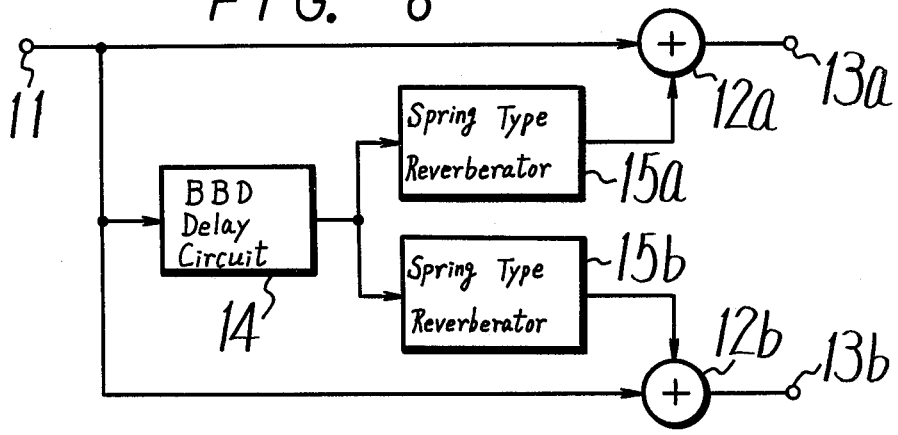
FIGS. 6 and 7 are block diagrams showing other examples of the invention.

According to the example of FIG. 6, the reverberation sound is obtained from left and right speakers (not shown) so as to present the sound expansion feeling similar to that of stereophonic reproduction. That is, the output signal from the delay circuit 14 made of a BBD is applied to two spring type reverberators 15*a* and 15*b* whose output signals are respectively applied to adders 12*a* and 12*b* which are each supplied with the original signal through the input terminal 11. The output signals from the address 12*a* and 12*b* are respectively derived through output terminals 13*a* and 13*b*.

According to the example shown in FIG. 6, it will be easily understood that the same effects obtained by that shown in FIG. 3 are performed. In addition, with the example of FIG. 6, two speakers can be driven so that the expansion feeling similar to that of stereophonic reproduction can be realized.

Figure 7:
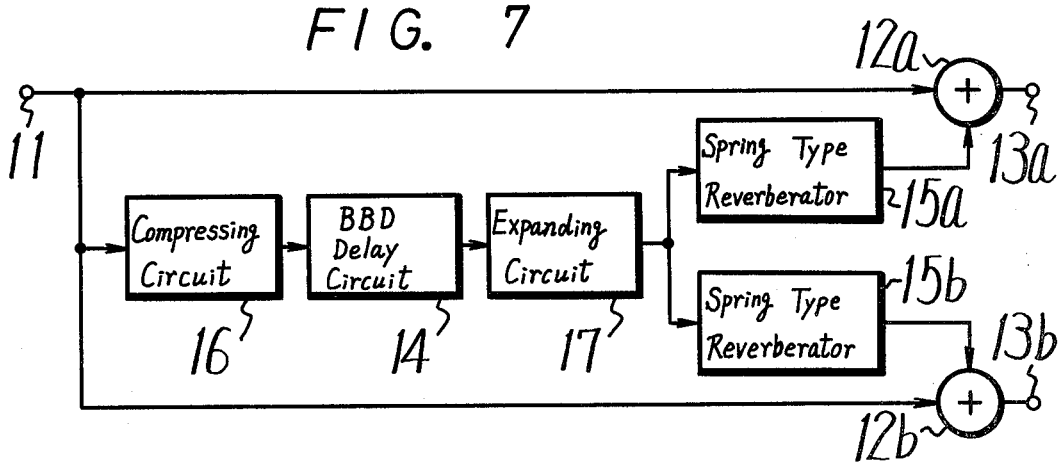

With reference to FIG. 7, a further example of the invention will be described in which the reference numerals are the same as those of FIGS. 3 and 6 and designate the same elements and parts. In the example of FIG. 7, a compressing circuit 16 and an expanding circuit 17 are used in addition to the circuitry shown in FIG. 6. In detail, the original signal passed through the input terminal 11 is applied to the compressing circuit 16 to be amplitude-compressed and then fed to the delay circuit 14 made of a BBD. The output signal from the latter is supplied to the expanding circuit 17 to be amplitude-expanded so as to be returned to the signal with the original amplitude. The output signal from the expanding circuit 17 is supplied to the spring type reverberators 15*a* and 15*b* whose output signals are respectively supplied to the adders 12*a* and 12*b*. The expanding and compressing circuits are well known in the prior art and may comprise an amplifier and attentuator, respectively.

According to the embodiment of FIG. 7, it will be easily understood that the same effects as those attained by that of FIG. 6 are obtained. Furthermore, according to the example of FIG. 7, since the original signal is amplitude-compressed by the compressing circuit 16 and then fed to the delay circuit 14, this delay circuit 14 is prevented from being saturated and hence clipping of the reverberation sound can be avoided. Furthermore, since the level of the input signal to the BBD forming the delay circuit 14 is suppressed, the BBD can be operated in a range where less noise is generated and accordingly, the SN ratio can be improved.

An example will be now described with reference to FIG. 8 in which an example of the reverberation apparatus according to the invention is applied to a mixing apparatus.

Figure 8:
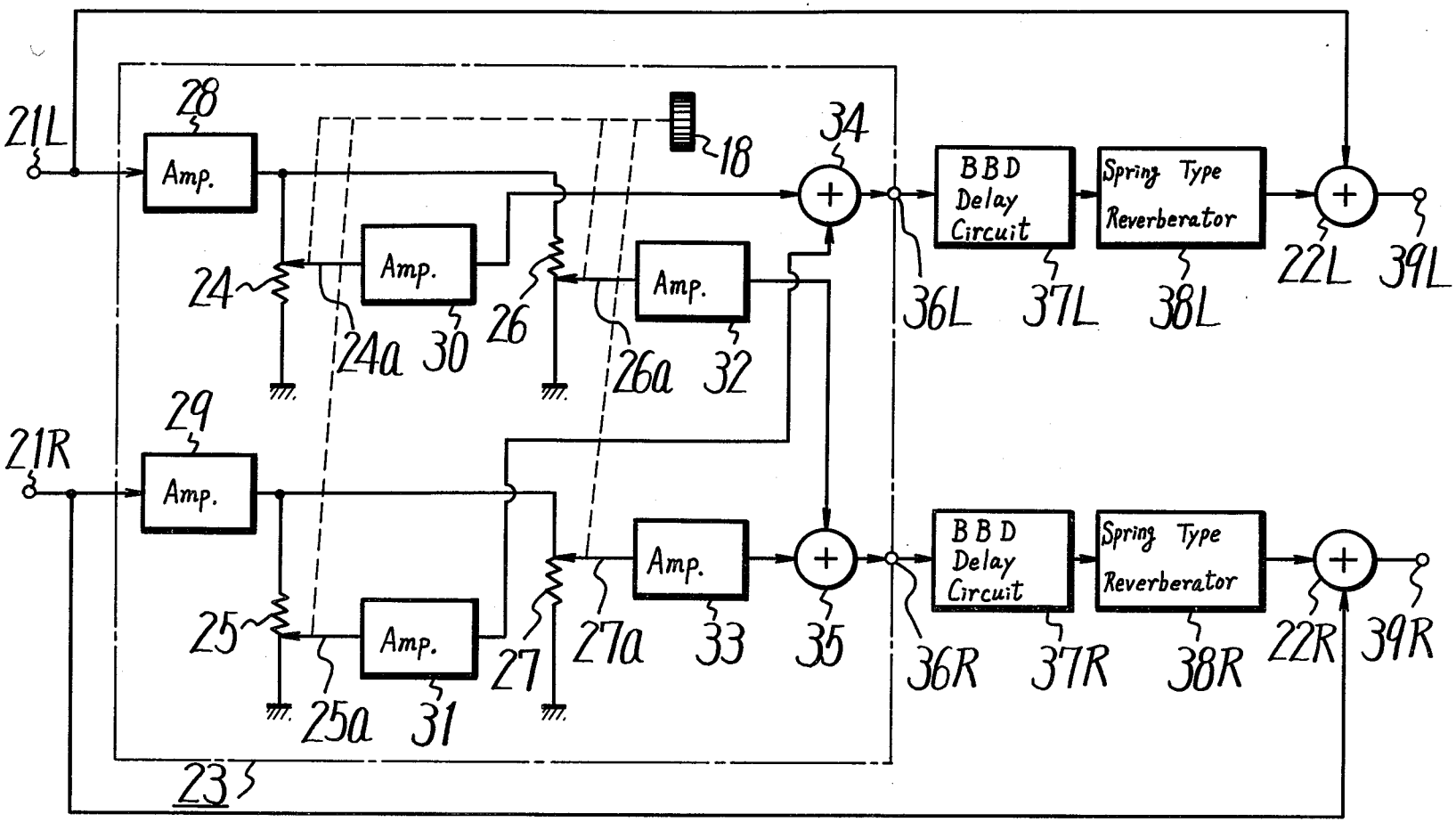
FIG. 8 is a block diagram showing a mixing circuit to which an example of the invention is applied.

In FIG. 8, 21L designates an input terminal which is supplied with a left channel signal and is directly connected to an adder 22L. The left channel signal applied to the input terminal 22L is supplied to a mixing circuit 23 to which the present invention is applied. A right channel signal is applied through an input terminal 21R to an adder 22R directly and also to the mixing circuit 23.

The mixing circuit 23 consists of four variable resistors 24, 25, 26 and 27; six buffer amplifiers 28, 29, 30, 31, 32 and 33; and two adders 34 and 35. It functions to mix the applied left and right channel signals with each other and then supply two mixed signals to interior output terminals 36L and 36R, respectively. In detail, the left and right channel signals applied to the input terminals 21L and 21R are respectively supplied to one end of each of the variable resistors 24 and 25 through the buffer amplifiers 28 and 29. The other end of each of these variable resistors 24 and 25 are respectively grounded, and the signals obtained at movable arms 24*a* and 25*a* of the variable resistors 24 and 25 are both applied through the buffer amplifiers 30 and 31 to the adder 34. The output signal therefrom is delivered to the interior output terminal 36L.

The left and right channel signals passed through the input terminals 21L and 21R and buffer amplifiers 28 and 29 are respectively supplied to one end of each of the variable resistors 26 and 27, the other ends of which are respectively grounded. The signals obtained at movable arms 26*a* and 27*a* of the variable resistors 26 and 27 are both applied through the buffer amplifiers 32 and 33 to the other adder 35 whose signal is delivered to the other interior output terminal 36R.

In this case, the variable resistors 24 to 27 are all of a B-curve characteristic and together form a four-ganged variable resistor. When a common knob 18 of the variable resistors 24 to 27 is rotated, resistance values $R_1$ and $R_4$ of the variable resistors 24 and 27 (where $R_1$ and $R_4$ are resistance values of the variable resistors 24 and 27 between their ground ends and the positions where their movable arms 24*a* and 27*a* rest, which is similar to the other variable resistors 25 and 26) are together increased or decreased in the same direction as indicated by a curve or straight line $R_{1,4}$ in the graph of FIG. 9. On the other hand, resistance values $R_2$ and $R_3$ of the other variable resistors 25 and 26 are together increased or decreased in the same direction opposite to those of the variable resistors 24 and 27 as indicated by a curve or straight line $R_{2,3}$ in the graph of FIG. 9.

Figure 9:
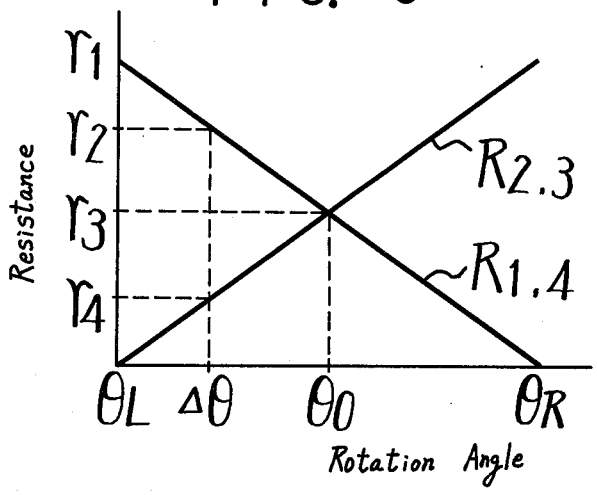
FIG. 9 is a graph showing the characteristic of the variable resistors used in the mixing circuit shown in FIG. 8.

In this case, the knob 18 of the variable resistors 24 to 27 is so constructed that when it is rotated to its mid point i.e. center angular position $\theta_0$ (refer to the graph of FIG. 9) of its effective rotational angle, a click feeling can be perceived. When the knob 18 of the variable resistors 24 to 27 is rotated to its mid point $\theta_0$, the resistance values $R_1$, $R_2$, $R_3$ and $R_4$ thereof become all the same value $r_3$ as shown in the graph of FIG. 9. Accordingly, it is easy to see that if the click feeling is ascertained by rotating the knob 18 to its mid point $\theta_0$, the respective resistance values $R_1$ to $R_4$ of the variable resistors 24 to 27 can be selected to be equal.

According to the example shown in FIG. 8, two signals (which will be referred to as first and second mixed signals) provided by the mixing circuit 23 and delivered to the interior output terminals 36L and 36R, are respectively supplied to delay circuits 37L and 37R (each formed of a BBD) to be delayed by a predetermined time. The first and second mixed signals thus delayed by the delay circuits 37L and 37R are respectively applied to spring type reverberators 38L and 38R from which first and second reverberation signals are derived. The first and second reverberation signals thus provided are respectively applied to the adders 22L and 22R to be added to the left and right channel signals and then delivered to outer output terminals 39L and 39R, respectively.

At first, a case will be described in which a stereophonic and natural expansion feeling of the sound is presented. In order to obtain the stereophonic and natural expansion feeling of the sound, it is sufficient that the left and right channel signals are respectively fed to the other output terminals 39L and 39R in such a state that they are completely separated; and that the reverberation signals for the left and right channel signals are mixed at a suitable mixing ratio and then respectively added to the left and right channel signals which are directly fed.

According to the example of FIG. 8, the left and right channel signals are previously mixed by the mixing circuit 23 at the suitable mixing ratio, and then the first and second mixed signals thus provided are used to produce the first and second reverberation signals, which are substantially the same as those signals provided by mixing the reverberation signals of the left and right channel signals at the suitable mixing ratio.

Figure 10A:
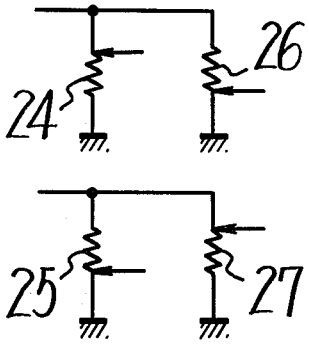
FIGS. 10A to 10D are circuit diagrams respectively showing the different ganged states of the variable resistors used in the mixing circuit of FIG. 8.

It is assumed that when the knob 18 of the variable resistors 24 to 27 is rotated in the counter-clockwise direction to its full position (refer to FIG. 10A), the angular position of the knob 18 at this state is taken as $\theta_L$ (refer to FIG. 9). At this time, the resistance values $R_1$ and $R_4$ of the variable resistors 24 and 27 are both $r_1$ while resistances $R_2$ and $R_3$ of the variable resistors 25 and 26 are both zero.

Figure 10B:
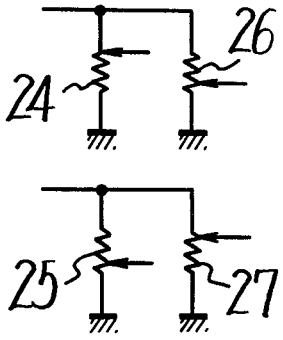

When the knob 18 is rotated in the clockwise direction by a predetermined angle $\Delta\theta$ form the above position, the respective variable resistors 24 to 27 assume the states as shown in FIG. 10B. At this time, the resistance values $R_1$ and $R_4$ decrease from $r_1$ to $r_2$, while resistance values $R_2$ and $R_3$ increase from zero to $r_4$. The addition of the signals at the adder 34 is such that the level of the second channel signal compared to that of the first channel signal is $r_4$ to $r_2$. Accordingly, the first channel signal serving as the main signal is mixed with the second channel signal of a low level in supplementary fashion to provide the first mixed signal (since $r_2 > r_4$). While at the other adder 35, contrary to the former, the second channel signal serving as the main signal is mixed with the first channel signal of a low level to be the second mixed signal. The above will now be further explained below.

Based upon the first mixed signal thus provided, the first reverberation signal is produced by the delay circuit 37L and reverberator 38L located at the rear stage. The first reverberation signal is comprised of the reverberation signal of the left channel signal as the main signal component and the reverberation signal of the low level right channel signal is mixed to the former due to the property of the first mixed signal. The second reverberation signal is comprised of the reverberation signal of the right channel signal as the main signal component and the reverberation signal of the low level left channel signal is mixed to the former.

When the first and second reverberation signals produced as set forth above are added to the left and right channel signals at the adders 22L and 22R, respectively, a sound effect with an expanding feeling can be presented. For example, from a speaker (not shown) for the left channel, mainly heard are the sound of the left channel and the reverberation sound of the left channel. Also, little is heard of the reverberation sound of the right channel, while from a speaker (not shown) for the right channel, mainly heard are the sound of the right channel and the reverberation sound of the right channel. Little is heard of the reverberation sound of the left channel.

Figure 10C:
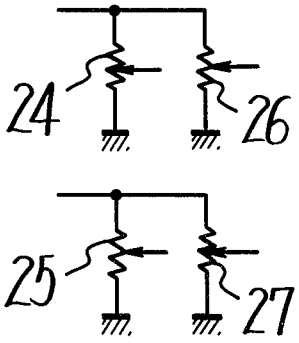
Figure 10D:
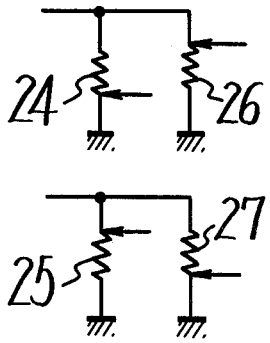

In addition to providing the sound effect with an expanding feeling, it may be possible that when enjoying rock music and so on, the reverberation sound of the right channel is heard from, for example, the left channel speaker while the reverberation sound of the left channel is heard from the right channel speaker. In this case, it is enough that the knob 18 is rotated in the clockwise direction or the angular position of the knob 18 is set at $\theta_R$ (refer to FIG. 9) to position the variable resistors 24 to 27 as shown in FIG. 10D.

Since, in the example shown in FIG. 8, the angular position of the knob 18 can be continuously varied from $\theta_L$ (or $\theta_R$) to $\theta_R$ (or $\theta_L$), the mixing ratio between the left and right channel signals can be set in a desirable manner and hence a desired sound effect can be obtained. For example, when the angular position of the knob 18 is set at $\theta_0$ (refer to FIG. 9), the resistors 24 to 27 are set at the positions shown in FIG. 10C. Therefore, the resistance values $R_1$, $R_2$, $R_3$ and $R_4$ all become the same value $r_3$ so that the first and second mixed signals obtained at the interior output terminals 36L and 36R become monaural signals, respectively. As a result, a sound effect can be presented such that although the original sound is stereophonic, the reverberation sound is monaural.

As described above, according to the mixing circuit 23 shown in FIG. 8, while the first signal such as the left channel signal is applied through the variable resistors 24 and 26 to the adder 34 and 35, the second signal, for example, right channel signal, is supplied through the variable resistors 25 and 27 to the adders 34 and 35. Also the variable resistors 24 to 27 are varied in a ganged relation to increase or decrease the resistance values $R_1$ and $R_4$ of the variable resistors 24 to 27 in the same direction, while increasing or decreasing the resistance values $R_2$ and $R_3$ of the variable resistors 25 and 26 in the same direction, which is opposite to the former direction. Therefore, it is possible that the first and second signals are continuously varied, such as in a completely separated state, mixed state, monarual state, and exchanged state to produce the first and second mixed signals. In addition, since all the variable resistors 24 to 27 are ganged with one another, the above-mentioned variations can be established by operating the single knob 18, which is very convenient for operation.

The reverberation apparatus for 2-channel operation is explained as an example with reference to FIG. 8, but it is of course possible to employ the present invention as a reverberation apparatus for 4-channel operation. For this purpose it is sufficient that the mixing circuit 23 shown in FIG. 8 is used twice.

By the example shown in FIG. 8 similar to the example of FIG. 6, the original sound can be clearly reproduced, and natural reverberation sound can be obtained by the spring type reverberator.

In the example of FIG. 8, the variable resistors 24 to 27 are each of a rotary type, but it is possible that they are each of a sliding type.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A reverberation apparatus, comprising:

a signal input terminal to be supplied with an input signal;

delay circuit means having input and output terminals;

said delay circuit means input terminal being connected to said signal input terminal;

a spring type reverberator having input and output terminals, the input terminal of which is connected to the output terminal of said delay circuit means;

summing means having a pair of input terminals and output terminal, the pair of input terminals being respectively connected to said signal input terminal and the output terminal of said spring type reverberator, and the output terminal of said summing means having a desired reverberation sound produced thereat; and said delay circuit means producing a delay time such that a relatively high level spring type reverberation sound signal produced by the spring type reverberator appears at the output terminal after said delay time relative to application of the input signal.

2. A reverberation apparatus according to claim 1 in which said delay circuit means comprises a bucket brigade device.

3. A reverberation apparatus, comprising:

a signal input terminal to be supplied with an input signal;

delay circuit means having input and output terminals, the input terminal of which is connected to said signal input terminal;

first and second spring type reverberators, each having input and output terminals, the input terminals of which are connected together to the output terminal of said delay circuit means;

first summing means having a pair of input terminals and an output terminal, one input terminal of which is connected to said signal input terminal, the other input terminal of which is connected to the output terminal of said first spring type reverberator, the output terminal of which has a first reverberation sound produced thereat;

second summing means having a pair of input terminals and an output terminal, one input terminal of which is connected to said signal input terminal, the other input terminal of which is connected to the output terminal of said second spring type reverberator, and the output terminal of which has a second reverberation sound produced thereat; and said delay circuit means producing a delay time such that a relatively high level spring type reverberation sound signal produced by the spring type reverberator appears at the output terminals after said delay time relative to application of the input signal.

4. A reverberation apparatus according to claim 3 in which said delay circuit means comprises a bucket brigade device.

5. A reverberation apparatus according to claim 3, further including:

signal compressing circuit means connected between said signal input terminal and the input terminal of said delay circuit means; and signal expanding circuit means connected between the output terminal of said delay circuit means and the input terminals of said first and second spring type reverberators.

6. A reverberation system, comprising:

a signal input terminal for connection to a signal source;

a delay circuit means connected to the signal input terminal for delaying a signal from the signal source by a predetermined time period;

a mechanical spring type reverberator connected to an output of the delay circuit means;

an adder means for adding the signal from the signal input terminal and from an output of the spring type reverberator so as to provide at its output a desired reverberation sound; and said delay circuit means producing a delay time such that a relatively high level spring type reverberation sound signal produced by the spring type reverberator appears at the output terminal after said delay time relative to application of the input signal.

7. The system of claim 6 wherein the delay circuit means comprises a bucket brigade device.

8. A reverberation apparatus, comprising:

first and second signal input terminals to be supplied with first and second input signals;

first and second delay circuit means connecting to respective first and second spring type reverberators in series with the delay circuit means;

first and second summing means each having respective first and second inputs and an output terminal, a first input of each summing means connecting to the respective first and second reverberator at an output thereof;

the first and second signal inputs respectively connecting to the second inputs of the respective first and second summing means; and a mixing apparatus having respective first and second mixing means connecting to respective inputs of the first and second delay circuit means, each of the first and second mixing means mixing a respective signal from the first or second signal input with a signal from the other second or first signal input in adjustable proportions.

* * * * *